US005672093A

United States Patent [19]

DuBois

[11] Patent Number: 5,672,093

[45] Date of Patent: Sep. 30, 1997

[54] SPECIMEN LOAD CONTROL MECHANISM FOR AUTOMATIC POLISHING APPARATUS

[75] Inventor: Chester G. DuBois, Zion, Ill.

[73] Assignee: Buehler, Ltd., Lake Bluff, Ill.

[21] Appl. No.: 426,820

[22] Filed: Apr. 21, 1995

[51] Int. Cl.[6] ..... B24B 21/00

[52] U.S. Cl. ..... 451/14; 451/313; 451/314; 451/317

[58] Field of Search ..... 451/11, 12, 14, 451/285, 286, 287, 288, 291, 270, 271, 313, 317, 312, 314

[56] References Cited

U.S. PATENT DOCUMENTS 3,892,092 7/1975 Keith, Jr. .

3,906,678 9/1975 Roth ..... 451/317

*Primary Examiner*—Eileen P. Morgan

[57] ABSTRACT

An improved mechanism for applying a controlled load to a specimen being polishing in an automatic polishing machine including a tension spring for exerting a downward load which is transmitted to the specimen to press the same against an abrasive polishing member, and a stepper motor connected by a plurality of mechanical elements to one end of the tension spring whereby through use of a microprocessor the stepper motor may be operated to control the load applied to the specimen.

12 Claims, 4 Drawing Sheets 30
44
42
46
80
50
66
90
102
92
94
60
112
82
100
68,70
62

44
42
46
30
80
50
66
60
112
102
82
92
100
90
94
68,70

SPECIMEN LOAD CONTROL MECHANISM FOR AUTOMATIC POLISHING APPARATUS

BACKGROUND OF THE INVENTION

Field of the Invention

The present invention relates to a mechanism for applying a controlled load to a specimen being polished in an automatic polishing machine.

The specimen load control mechanism of the present invention is for use in a polishing machine of the type shown in U.S. Pat. No. 3,892,092, which is assigned to the assignee of the present invention. The '092 patent discloses an automatic polishing apparatus for polishing the surface of a specimen for purposes of microstructural analysis. The foregoing patent discloses a drive arm 40 which is movable both pivotally and axially and is connected at its outer end to a specimen holder 38 so as to move a specimen through a multi-directional path over a flat, horizontal polishing surface comprising the base of a cup-shaped member containing abrasive slurry or the like.

In the foregoing polishing apparatus, one drive means imparts a relatively high speed circular motion to an inner end of the drive arm 40, while a second drive means imparts a relatively low speed circular motion thereto, the composite of such motions being transmitted to the outer end of the drive arm 40 which guides the specimen over the flat polishing surface. The polishing apparatus shown in the '092 patent includes mechanism for automatically controlling the loading of a specimen against a polishing surface.

FIG. 8 of the '092 patent shows the drive arm 40 which includes a depending portion 42 at its outer end. The depending portion 42 extends down into a hole in the middle of a specimen holder 38, a specimen being embedded in the bottom surface of the holder 38 as is well known in the art. As noted earlier, the drive arm 40 is movable both pivotally and axially so as to move the specimen holder 38 around a bowl 28 and over the top of a polishing disc 36 which sits on a glass platen 34 in the bottom of the bowl 28. Still referring to FIG. 8 of the '092 patent, a bushing 44 is mounted on the drive arm 40 and held thereon by a set screw 48. The bushing 44 moves between a pair of bearing walls 50 (see FIG. 2) so that the bushing 44 moves left or right as viewed in FIG. 2, while the drive arm 40 moves left and right and also pivots. FIG. 8 shows a load spring 130 having an upper end which is anchored to the bushing 44 by a pin 138. The lower end of spring 130 is anchored to a lever 142 which can pivot about a pin 143.

The lever 142 is pivoted down about pin 143 in order to apply a downward load to spring 130 and thereby apply a downward load to drive arm 40 and in turn to the specimen holder 38. Such downward pivoting of lever 142 is achieved by a manual control knob 156 which rotates a shaft 150 and in turn rotates a cam 134, 146 which exerts a downward force on the end of lever 142. In the foregoing manner, an operator can apply a controlled downward load on specimen holder 38 by rotating the knob 156 to a selected position.

The '092 patent further describes, at col 6, line 54 through col 7, line 34, mechanism for gradually decreasing the downward pull on the spring 130 for the purpose of achieving finer polishing of a specimen toward the end of a polishing cycle.

It is an object of the present invention to provide an improved mechanism for applying a downward load on a polishing specimen and for reducing the load during a polishing operation.

Another object of the invention is to control a downward force on a specimen electro-mechanically to achieve greater accuracy than was heretofore possible.

A further object is to provide force-applying mechanism which produces more consistent loads on a specimen when specimens to be polished are of different heights.

Still another object of the invention is to provide force-applying mechanism as above-mentioned including a stepper motor whereby load is determined by the number of pulses of the stepper motor.

The foregoing objects and advantages of the invention will be apparent from the following description of a preferred embodiment, taken in conjunction with the accompanying drawings.

Now, in order to acquaint those skilled in the art with the manner of making and using my invention, I shall describe, in conjunction with the accompanying drawings, a preferred embodiment of the invention.

DETAILED DESCRIPTION OF THE INVENTION

Figure 1:
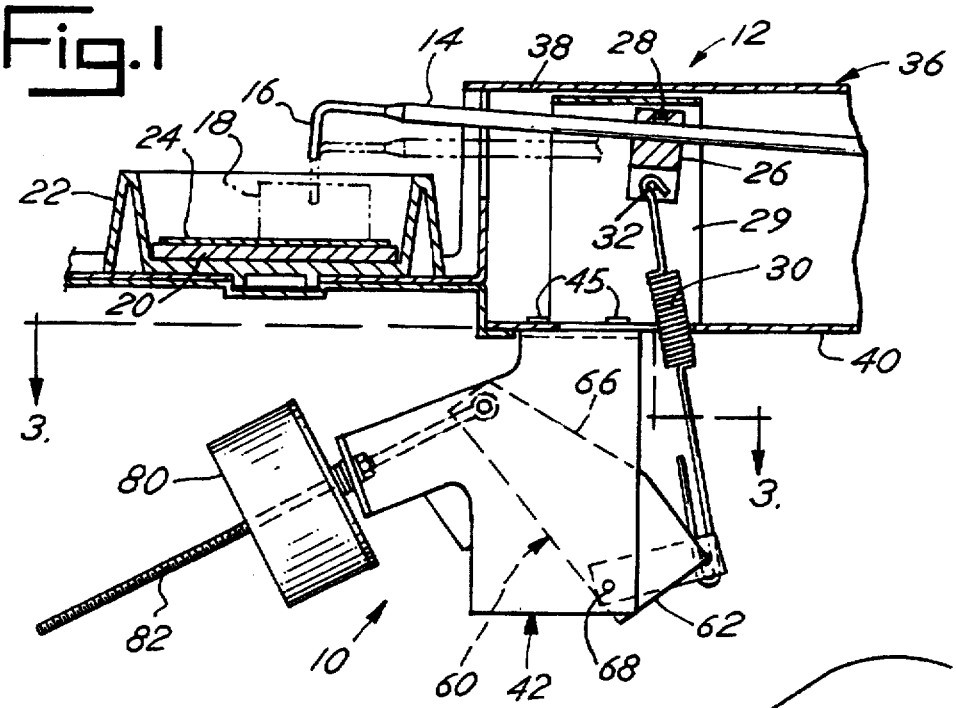
FIG. 1 is a side elevational view of an improved load control mechanism in accordance with the invention, a fragmentary portion of an automatic polishing machine to which the load control mechanism is attached being shown in vertical section.

FIG. 1 shows the improved load control mechanism 10 in conjunction with a portion of a known automatic polishing machine 12. There is shown the outer end of a drive arm 14 having a depending portion 16 designed to engage inside of a central hole in a specimen holder 18. FIG. 1 shows the drive arm 14 in solid lines in a raised position and in dotted lines in a lowered position where it is engaged to drive a specimen holder 18. As is known in the art, a specimen to be polished is embedded in the bottom surface of the specimen holder 18.

As is described more fully in U.S. Pat. No. 3,892,092, a glass platen 20 is positioned in the bottom of a bowl 22, and an abrasive disc 24 is positioned on the platen 20. In operation, the drive arm 14 moves the specimen holder 18 around in the bowl 22 over the abrasive disc 24 to polish a specimen embedded in the bottom surface of the specimen holder.

Still referring to FIG. 1, the drive arm 14 has a bushing 26 positioned thereon and held by a set screw 28. As is more fully described in the foregoing '092 patent, the bushing can move left and right as shown in FIG. 1 between a pair of bearing walls 29, and the drive arm 14 can also pivot about a vertical axis. In addition, a tension spring 30 has its upper end connected to bushing 26 by a pin 32, and application of a downward pull on the spring 30 will pull down on the outer end of drive arm 14 and thereby apply a downward force on specimen holder 18 to press the embedded specimen against the abrasive disc 24. In the foregoing manner, it is possible to apply a controlled load on the specimen during a polishing operation by applying a downward pull on the tension spring 30.

The present invention relates to improved electromechanical mechanism for applying a controlled downward pull on the spring 30 for the purpose of loading a specimen during a polishing operation. FIG. 1 shows a frame 36 of the automatic polishing machine, the frame including a top wall 38 and a bottom wall 40. A bent metal frame 42 (see also FIG. 2) for the load control mechanism 10 includes a top wall 44, side walls 46 and 48, and a pair of bent tabs 50.

The bottom of frame 42 is open, and the side walls 46 and 48 are spaced apart to provide interior space to accommodate various mechanical parts of the load control mechanism. FIG. 1 shows the manner in which the top wall 44 of frame 42 is secured by screws or the like 45 to the bottom wall 40 of frame 36 of the polishing machine for the purpose of mounting the load control mechanism 10 to the frame of the polishing machine 12.

Figure 2:
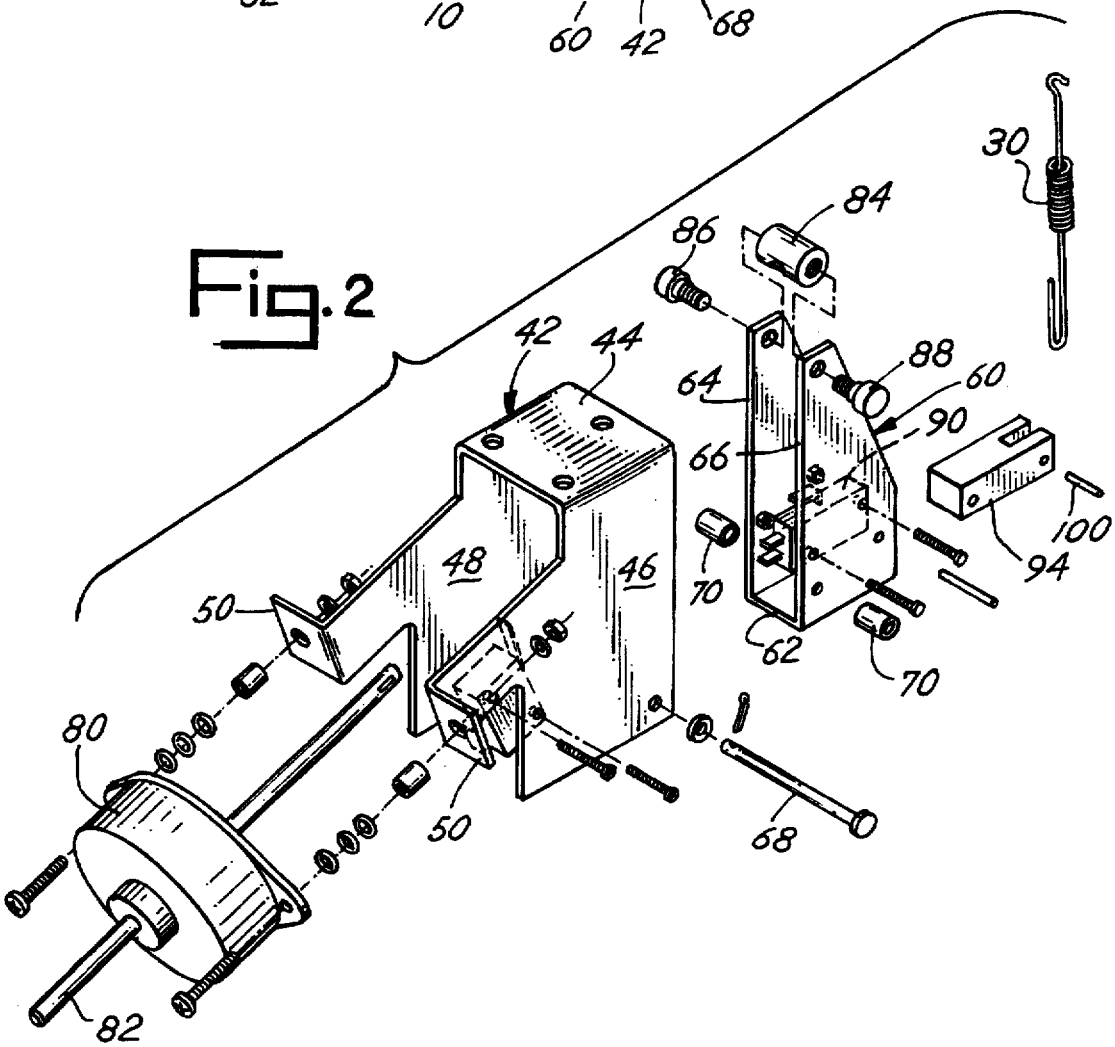
FIG. 2 is an exploded perspective view of the load control mechanism of the present invention.

As shown in FIGS. 1–4, a lever 60 comprises a bent metal member having a base 62 and a pair of side walls 64 and 66 (see FIG. 2). The lever 60 is mounted between the walls 46 and 48 of frame 42 and pivots about a pin 68 which extends through side walls 46 and 48 of frame 42 near the lower end thereof. A pair of sleeves 70 are positioned on the pin 68 between the walls 64 and 66 of the lever 60 and the side walls 46 and 48 of frame 42 so as to maintain lever 60 positioned centrally between the walls 46 and 48.

Figure 3:
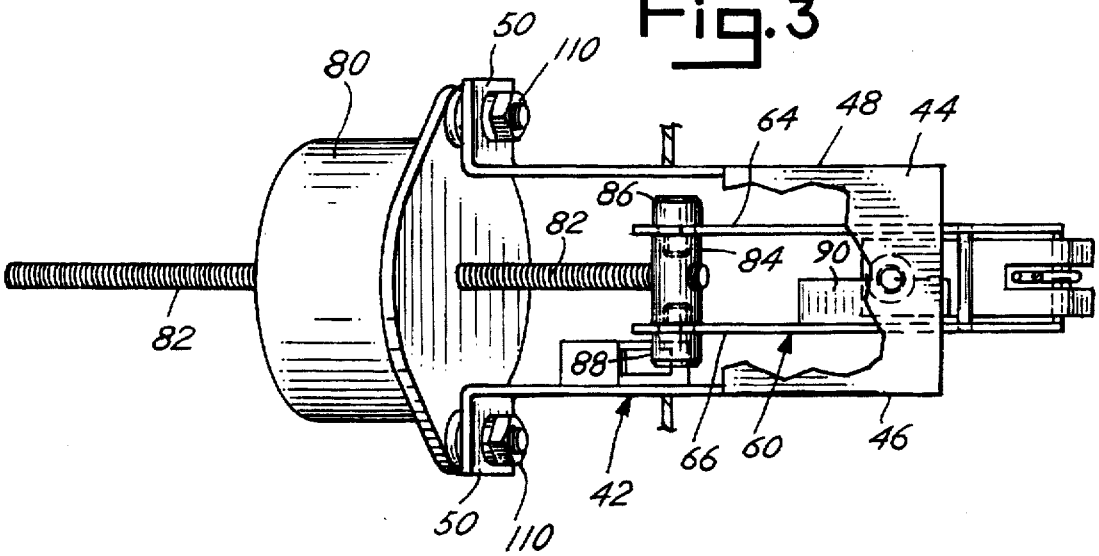
FIG. 3 is an enlarged top view of the load control mechanism of the present invention taken along the line 3—3 of FIG. 1.
Figure 4:
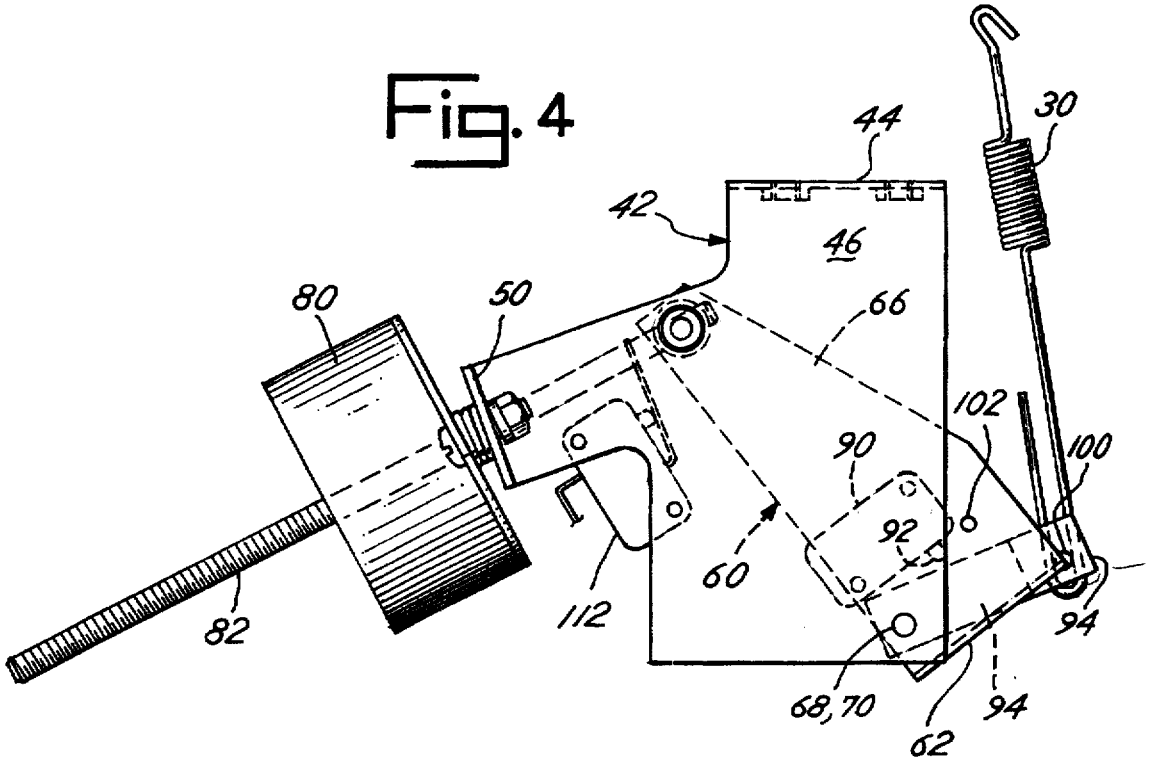
FIG. 4 is a side elevational view of the load control mechanism of FIG. 3 showing a pivotal lever in its counterclockwise position where no downward load is applied to a load spring for loading a specimen.
Figure 6:
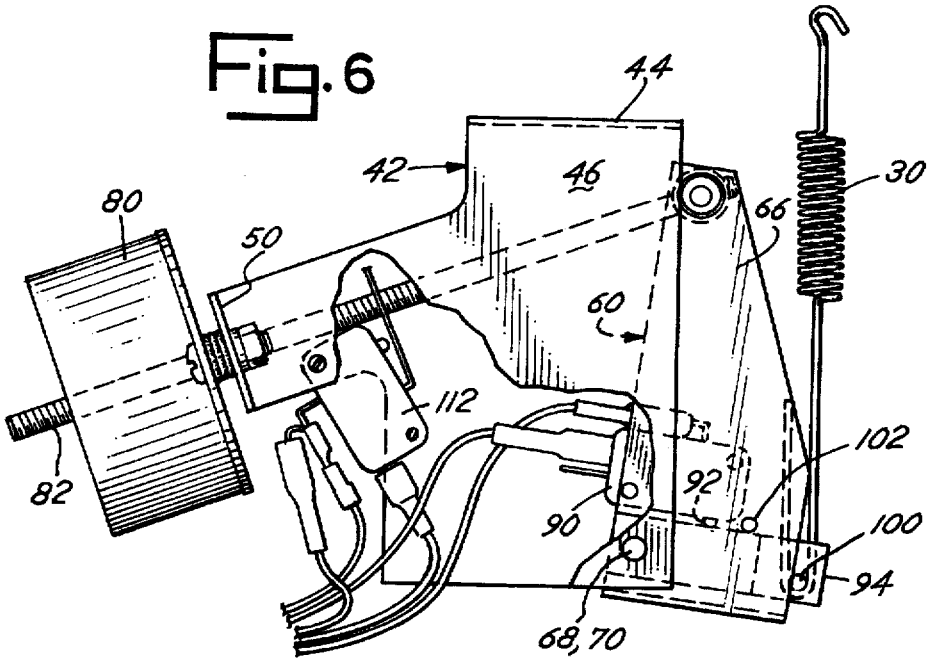
FIG. 6 is a view similar to FIG. 4 showing the pivotal lever in its full clockwise position where a maximum downward load is applied to the load spring.

A stepper motor 80 has a threaded rod 82 which extends through it and is moved axially in either direction through operation of the motor. FIG. 3 shows the threaded rod 82 extending approximately equal amounts from the two sides of motor 80. FIG. 4 shows the rod 82 in its fully retracted or down position, and FIG. 6 shows the threaded rod 82 in its fully extended or up position. The number of pulses of the stepper motor 80 will determine the amount of axial movement of the rod 82.

As shown in FIG. 2, a bushing 84 is positioned between sidewalls 64 and 66 at the upper ends thereof, and a pair of short screws 86 and 88 extend through the walls 64 and 66, respectively, and are threaded into opposite ends of bushing 84. In the foregoing manner, bushing 84 is held in position as shown in FIGS. 3–6, but it is capable of limited rotation. The upper end of threaded rod 82 is threaded into bushing 84 so as to extend between the screws 86 and 88. In the foregoing manner, the upper end of rod 82 is connected to lever 60 so that movement of the rod upward and to the right as viewed in FIG. 4 will pivot lever 60 clockwise, and movement of rod 82 downward and to the left will pivot lever 60 in a counterclockwise direction.

A switch 90 is provided for control of stepper motor 80. As shown in FIGS. 3 and 4, the switch 90 is fixedly mounted to sidewall 66 of lever 60 and it includes a switch actuation button 92 shown in FIG. 4 which is positioned to be actuated by a block member 94. The block 94 is located near the base 62 of lever 60 between the sidewalls 64 and 66. One end of block 94 is mounted on pin 68 so it can pivot a limited amount about that pin, which is also true of lever 60 as previously described. However, the pivotal movement of block 94 about pin 68 is independent of the pivotal movement of lever 60.

Figure 5:
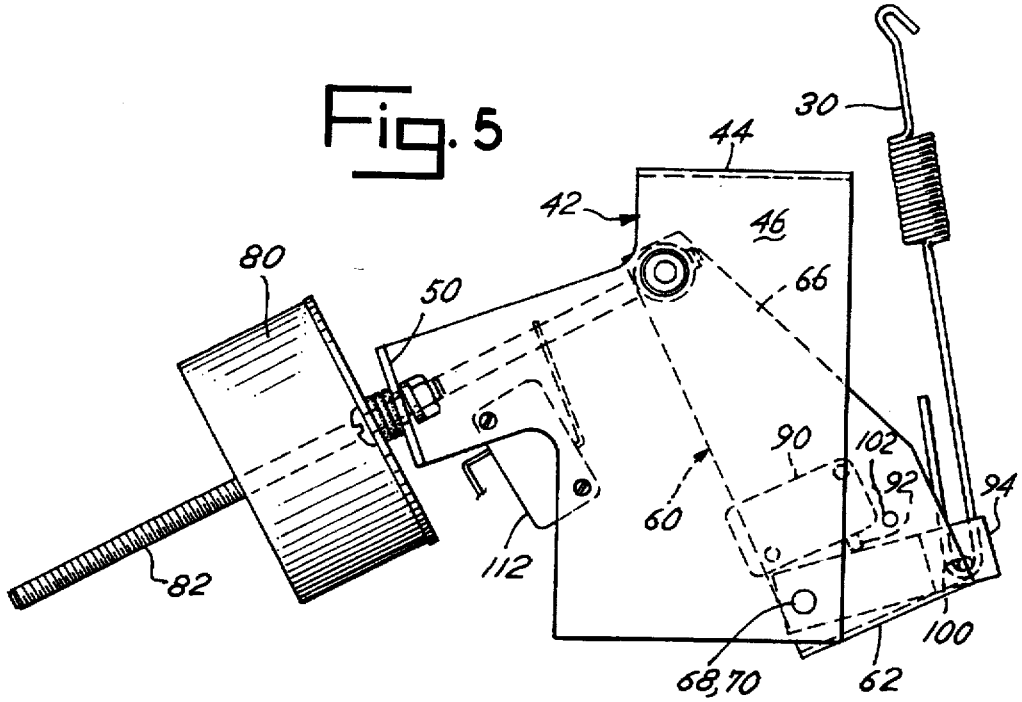
FIG. 5 is a view similar to FIG. 4 showing an intermediate position of the pivotal lever.

The outer end of pivotal block 94 is bifurcated and has a pin 100 to anchor the lower end of tension spring 30. As previously described in connection with FIG. 1, the upper end of spring 30 is connected to bushing 26 for the purpose of pulling down on drive arm 14. The block 94 is pivotally movable a limited amount about pin 68. The block 94 will be positioned in a clockwise position as shown in FIG. 4 where it will rest due to gravity on the base 62 of lever 60 when there is no upward pull from spring 30. However, when there is tension in spring 30, the resulting upward pull on the block 94 will pivot it in a counterclockwise direction as shown in FIG. 5 where it will actuate switch button 92. After actuating switch 90, limited further counterclockwise movement of block 94 will cause it to engage against a fixed cotter pin 102 which extends between the sidewalls 64 and 66 of lever 60. Cotter pin 102 prevents block 94 from applying excessive force to switch 90 upon increased tension in spring 30.

The operation of the specimen load control mechanism of the present invention will now be described. At the beginning of a polishing operation, the specimen holder 18 with a specimen embedded in the bottom surface thereof is placed in the bowl 22 as shown in FIG. 1, and the depending portion 16 of drive arm 14 is positioned in a central opening in the specimen holder so arm 14 can drive the specimen holder 18 around the bowl 22 over the abrasive disc 24 to polish the specimen. The actual polishing operation is more fully described in U.S. Pat. No. 3,892,092.

One of the advantages of the present invention is that it can provide an accurate downward force on the specimen holder 18 regardless of the thickness or height thereof. In viewing FIG. 1, it will be understood that in the case of a relatively thick specimen, the end 16 of drive arm 14 will be in an unusually elevated position, with the result that the upper end of spring 30 will be in an elevated position. Similarly, where the specimen holder 18 is relatively thin, the upper end of the spring 30 will be in a lowered position.

Because of the foregoing, the present invention includes mechanism to sense when the spring 30 is first stretched so as to initiate a downward load on drive arm 14 and specimen holder 18. The reason for such mechanism is because the position of threaded rod 82 at the time the spring 30 first applies a downward load on drive arm 14 will vary depending on the thickness of specimen holder 18.

At the beginning of a polishing operation, the operator actuates stepper motor 80 to initiate movement of threaded rod 82 in a direction upward and to the right as viewed in FIG. 4. In the position shown in FIG. 4, at the beginning of a polishing operation, the lever 60 is in its counterclockwise position, and it can be seen that there is no downward pull being applied to the tension spring 30.

As the stepper motor 80 is operated to move threaded rod 82 upwardly and to the right, the position shown in FIG. 5 will be reached where the lever 60 has been pivoted in a clockwise direction to an extent that an initial downward pull has been applied to the spring 30 which in turn pulls upwardly on the block 94 causing block 94 to pivot counterclockwise about pin 68 until it actuates switch button 92 as shown in FIG. 5.

After the switch button 92 has been actuated, block 94 continues to be pulled counterclockwise by spring 30 so it contacts cotter pin 102. As a result, as lever 60 continues to be pivoted clockwise by stepper motor 80, block 94 will be pivoted clockwise with lever 60 to continually increase the downward pull on spring 30, while cotter pin 102 will protect switch 90 from being damaged due to a high load.

The purpose of the foregoing mechanism is to provide a signal which indicates when slack between the lower end of spring 30 and the pin 100 which exerts a downward pull on that spring has been taken out and the mechanism has begun to exert a downward force on specimen holder 18. As previously described, the amount of rotation of lever 60 needed to remove any such slack and initiate a downward pull on spring 30 will vary depending on the thickness of specimen holder 18. Regardless of such thickness, the mechanism of the present invention will afford a signal through actuation of switch 90 to indicate that slack in the force-applying mechanism has been eliminated and a downward force on arm drive arm 14 is being initiated. From that point on, it is possible to accurately control the magnitude of the downward force being applied to specimen holder 18 by simply counting the pulses of stepper motor 80 after actuation of switch 90.

As the stepper motor 80 moves the threaded rod 82 from the position of FIG. 4 toward the position of FIG. 6, and back to the position of FIG. 4 at the end of a polishing operation, limited tilting movement of motor 80 will occur relative to the tabs 50 of frame 42 to which the motor is attached. Such tilting movement is permitted due to the fact that the connection of motor 80 to frame tabs 50 effected by nut and bolt members shown at 110 in FIG. 3 is deliberately made loose enough to accommodate such movement of motor 80. Also, as previously described, upper end of rod 82 can pivot a limited amount relative to lever 60 due to the fact that bushing 84 is capable of rotation relative to lever 60.

Figure 7:
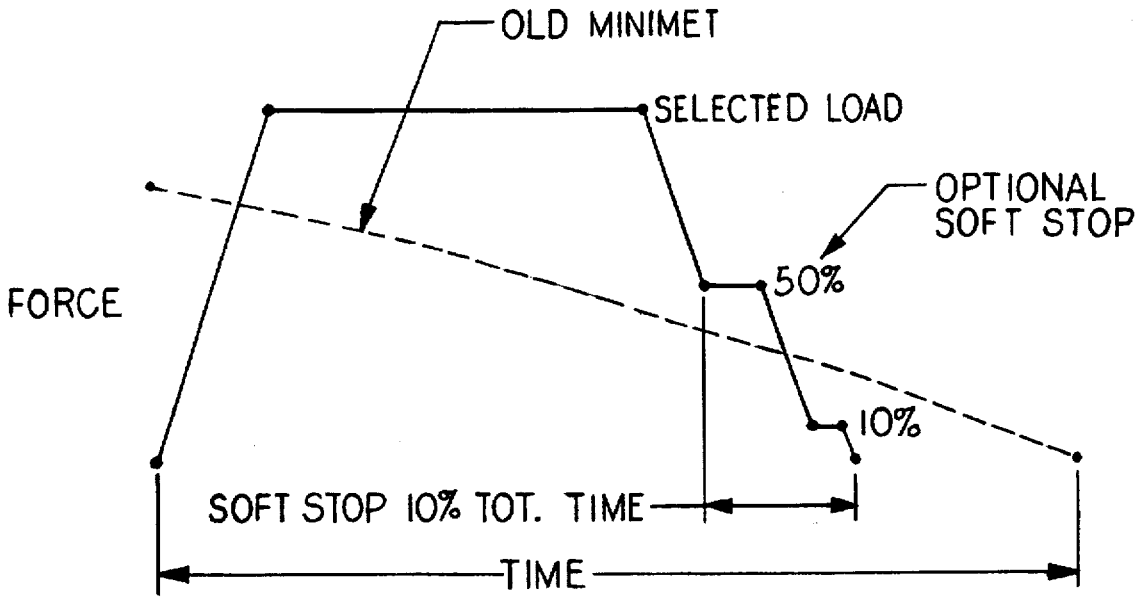
FIG. 7 is a graph which compares the characteristics of the mechanism of the present invention with those of the mechanism described in U.S. Pat. No. 3,892,092.

As explained above, the load-applying mechanism of the present invention allows a "soft start" and also controlled reduction in load toward the end of a polishing cycle as shown in FIG. 7. The graph line in FIG. 7 entitled "old Minimet" refers to the loading and unloading capability of the mechanism described in U.S. Pat. No. 3,892,092. The solid line shown in FIG. 7 provides one example of the type of loading afforded by the present invention.

In accordance with the present invention, load is determined by the number of pulses of stepper motor 80, and such pulses are counted after all slack in spring 30 is eliminated so that consistent loads may be applied even when samples to be polished are of different heights. No load is applied to spring 30 when lever 60 is in the counterclockwise position shown in FIG. 4. As lever 60 is rotated clockwise, switch 90 closes as soon as load is applied to spring 30 through block 94 as shown in FIG. 5. The foregoing position is the "zeroing" point for stepper motor 80 to start counting pulses to go to a predetermined desired load. At about the same time, cotter pin 102 which is attached to lever 60 contacts block 94 to rotate the block clockwise thus pulling down spring 30. Cotter pin 102 also carries the force to prevent force from damaging switch 90.

In use of the present invention, polishing times and force are preferably controlled by a microprocessor. The "zeroing" feature controls the stretch of spring 30 regardless of the tolerances of all parts and regardless of the height of the sample being polished.

Referring again to FIG. 7, the load-applying mechanism shown in U.S. Pat. No. 3,892,092 was only suitable for application of a load on a specimen of about three pounds. However, with some materials, such as certain ceramics, it is desirable to apply a much higher load, such as ten pounds. The mechanism of the present invention is capable of applying such a higher load. FIG. 7 also illustrates an example of the present invention where load may be varied in predetermined steps rather than being limited to the gradual force line for the prior design.

For example, with the present invention, force can be varied from two pounds to ten pounds in one pound increments, and such force may be selected in pounds or in newtons (1N =0.224 lb). The present invention will also provide an automatic soft start, and will permit the force to be reduced to zero automatically at the end of a time setting. The force can be changed during the cycle, and an operator can provide a controlled soft stop.

Time is preferably controlled in one-half to nine minutes in ten second increments, and in minutes to 99, plus constant on. At the end of a polishing cycle, the load should be removed from the specimen holder 18 so that the drive arm can be raised and the sample holder removed from the bowl 22. FIGS. 4–6 show a second switch 112 which serves as an upper limit switch to stop lever 60 in its up position.

What is claimed is:

1. In an automatic polishing machine of the type for polishing specimens for purposes of microstructural analysis, said machine including a housing, a polishing member on the homing having a flat polishing surface over which a specimen is moved during a polishing operation, and a specimen drive member supported on said housing and having a portion of said drive member engageable with a specimen holder for moving the same over said polishing surface, power means for operating said drive member, and a load member connected to said drive member for applying a controlled load on said drive member and on said specimen holder to press said specimen down against said polishing surface, the improvement comprising, in combination, a microprocessor-controlled stepper motor mounted to said housing and connected through a plurality of mechanical means to said load member for loading the (later) latter, (whereby), said stepper motor having a threaded rod extending through it which is moved axially in either direction through operation of said stepper motor, and said threaded rod being connected through said mechanical means to said load member, the number of pulses said stepper motor (will control) controlling the magnitude of said controlled load, whereby consistent controlled loads may be applied even when the specimens to be polished are of different heights.

2. Apparatus as defined in claim 1 where said mechanical means includes a pivotally mounted lever which is pivoted in clockwise and counterclockwise directions through axial movement of said threaded rod.

3. Apparatus as defined in claim 1 where said load member comprises a tension spring having one end connected to said drive member, and an opposite end of said tension spring being loaded by said mechanical means whereby operation of said stepper motor will apply said controlled load to said specimen.

4. In an automatic polishing machine of the type for polishing specimens for purposes of microstructural analysis, said machine including a housing, a polishing member on the housing having a flat polishing surface over which a specimen is moved during a polishing operation, and a specimen drive member supported on said housing and having a portion of said drive member engageable with a specimen holder for moving the same over said polishing surface, power means for operating said drive member, and a tension spring connected to said drive member for applying a controlled load on said drive member and on said specimen holder to press said specimen down against said polishing surface, the improvement comprising, in combination, a microprocessor controlled stepper motor mounted to said housing and connected through a plurality of mechanical means to said tension spring for loading the (later) latter, (whereby) the number of pulses to said stepper motor (will control) controlling the magnitude of said controlled load, said stepper motor having a threaded rod extending through it which is moved axially in either direction through operation of said stepper motor, and said threaded rod being connected through a plurality of mechanical means to said tension spring, said mechanical means including a pivotally mounted lever which is pivoted through axial movement of said threaded rod, whereby consistent controlled loads may be applied even when the specimens to be polished are of different heights.

5. Apparatus as defined in claim 4 where said threaded rod is connected to said pivotally mounted lever in a manner to permit limited pivotal movement between said threaded rod and said pivotally mounted member, and said stepper motor is mounted to a fixed frame in a manner to permit limited pivotal movement of said stepper motor relative to said frame.

6. Apparatus as defined in claim 4 where one end of said threaded rod is connected to one end of said pivotally mounted lever and an opposite end of said pivotally mounted lever is connected to said tension spring for applying a downward load on said drive member and on said specimen holder.

7. In an automatic polishing machine of the type for polishing specimens for purposes of microstructural analysis, said machine including a housing, a polishing member on the housing having a flat polishing surface over which a specimen is moved during a polishing operation, and a specimen drive member supported on said housing and having a portion of said drive member engageable with a specimen holder for moving the same over said polishing surface, power means for operating said drive member, and a tension spring having its upper end connected to said drive member for applying a controlled downward load on said drive member and on said specimen holder to press said specimen down against said polishing surface, the improvement comprising, in combination, motor means mounted to said housing and connected through a plurality of mechanical means to a lower end of said tension spring whereby operation of said motor means will impose a downward load on said tension spring and on said drive member and specimen holder, a switch mounted on one of said mechanical means, and another of said mechanical means comprising a switch actuating member having one end connected to the lower end of said tension spring and being positioned to actuate said switch, said switch actuating member being located so that application of a downward load to said tension spring will move said switch actuating member upwardly causing it to actuate said switch, said switch being connected to control said motor means to permit said motor means to apply a predetermined controlled downward load to said specimen measured from the time an initial downward load is applied to said tension spring.

8. Apparatus as defined in claim 7 where said motor means comprises a stepper motor.

9. Apparatus as defined in claim 7 including a frame attached to said housing, said motor means being mounted to said frame, and said switch actuating member being pivotally mounted to said frame at an end opposite to its said one end which is connected to said lower end of said tension spring, whereby application of a load to said tension spring will pivot said switch actuating member upward to actuate said switch.

10. Apparatus as defined in claim 7 where said motor means is a microprocessor controlled stepper motor controlled by said switch so that actuation of said switch will indicate that all slack has been taken out of said tension spring and thereafter the number of pulses to said stepper motor will determine the load applied to said tension spring and said specimen holder.

11. Apparatus as define in claim 9 where said mechanical means includes a threaded rod extending through said stepper motor and movable axially in either direction through operation of said stepper motor, one end of said threaded rod being connected to one end of a pivotal member carried on said frame an opposite end of said pivotal member being connected to said lower end of said tension spring so that operation of said stepper motor will produce a downward load on said tension spring.

12. In an automatic polishing machine of the type for polishing specimens for purposes of microstructural analysis, said machine including a housing, a polishing bowl on said housing having a flat bottom or polishing surface over which a specimen is moved during a polishing operation, and a specimen drive arm supported on said housing and having an outer end of said drive arm engageable with a specimen holder for moving the same over said polishing surface, motor means for operating said drive arm, and a tension spring having its upper end connected to said drive arm for applying a controlled downward load on said drive arm and on said specimen holder to press said specimen down against said polishing surface, the improvement comprising, in combination, a frame connected to said housing, a stepper motor mounted to said frame, a threaded rod extending through said stepper motor and movable axially in either direction through operation of said stepper motor, a lever pivotally mounted to said frame, said lever being connected at one end to an end of said threaded rod whereby operation of said stepper motor will cause said lever to be pivoted, said lever being connected at its opposite end through mechanical means to a lower end of said tension spring so that pivotal movement of said lever will load said tension spring whereby operation of said stepper motor will impose a downward load on said tension spring and on said drive arm and specimen holder, a switch mounted on said lever, and said mechanical means comprising a switch actuating member having one end connected to a lower end of said tension spring and being positioned to actuate said switch, said switch actuating member being located so that application of a downward load to said tension spring will move said switch actuating member upwardly causing it to actuate said switch, said switch being connected to control said stepper motor to permit said stepper motor to apply a predetermined controlled load to said specimen measured from the time an initial load is applied to said tension spring.

* * * * *

UNITED STATES PATENT AND TRADEMARK OFFICE

CERTIFICATE OF CORRECTION

PATENT NO. : 5,672,093

DATED : September 30, 1997

INVENTOR(S) : DuBois

It is certified that error appears in the above-identified patent and that said Letters Patent is hereby corrected as shown below:

Col. 6, ln. 25 reads "member on the homing having" and should read --member on the housing having--

Col. 8, ln. 15 reads "Apparatus as define in claim" and should read --Apparatus as defined in claim--

Signed and Sealed this

Twenty-fourth Day of February, 1998

*Attest:*

Bruce Lehman

BRUCE LEHMAN

*Attesting Officer*

*Commissioner of Patents and Trademarks*